United States Patent [19]

Miyamoto

[11] 4,043,235

[45] Aug. 23, 1977

[54] BACK-SPLITTING APPARATUS IN THE PRODUCTION OF BROCHURES

[75] Inventor: Toshio Miyamoto, Fukuoka, Japan

[73] Assignee: Marumiya Shoko Co., Ltd, Fukuoka, Japan

[21] Appl. No.: 718,558

[22] Filed: Aug. 30, 1976

[51] Int. Cl.[2] ..... B26D 3/12

[52] U.S. Cl. ..... 83/207; 83/4; 83/210; 83/240; 83/788; 83/925 A; 11/1 B; 270/21

[58] Field of Search ..... 83/4, 207, 210, 212, 83/240, 788, 925 A, 925 MC; 11/1 ET, 1 B; 270/21 X

[56] References Cited

U.S. PATENT DOCUMENTS 3,808,931 5/1974 Vulcano ..... 83/925 MG

FOREIGN PATENT DOCUMENTS 10,872 4/1970 Japan ..... 11/1 ET

*Primary Examiner*—Willie G. Abercrombie

*Attorney, Agent, or Firm*—Stevens, Davis, Miller & Mosher

[57] ABSTRACT

In the process of producing brochures such as account books, textbooks, notebooks and chits, a back-splitting operation which has hitherto been performed by hand is mechanically executed in such a way that a back-splitting cutter knife is attached to a turnable chain and that the cutter knife is thrust into the back portion of sheets of paper for the brochures, whereby the productivity of the process is enhanced and a sharp reduction in the cost thereof is achieved.

9 Claims, 4 Drawing Figures

BACK-SPLITTING APPARATUS IN THE PRODUCTION OF BROCHURES

This invention relates to a back-splitting apparatus used in the production of brochures such as account books, textbooks, notebooks, chits, memo-books and magazines. Laminated sheets of paper in which a plurality of brochures with front and rear covers are arranged for each copy stacked in piles and the back portion is starched or subjected to back fixation. The copies are separated into books where each copy has front and rear covers.

Usually, a back-splitting operation of this sort is not mechanically effected, but an operator separates the lamination into each copy with a hand knife or the like. Accordingly, the efficiency is very low, and the cost is high. Besides, the operation is dangerous as a hand knife or the like is used.

Moreover, since the back-splitting operation is performed by hand, only the sheets of paper cut into length and width dimensions corresponding to one copy can be handled at a time. As in, for example, when a succession of sheets of paper for three to four copies are in the lengthwise direction of the back portion starched to a single piece of paper, it is very difficult to carry out the back-splitting operation under these conditions.

This invention makes it possible to mechanically execute the back-splitting operation in the production of brochures such as account books, textbooks, notebooks, chits, memo-books and magazines, and has for its object to provide back-splitting apparatus with which, in both cases where sheets of paper of a size corresponding to one copy are layered and where sheets of paper succeeding by a plurality of copies in the lengthwise direction of the back portion are layered, the back-splitting operation is reliably and safely effected, whereby the productivity of the process can be enhanced several times in comparison with that of the prior art, so that a reduction in cost can be achieved.

Figure 1:
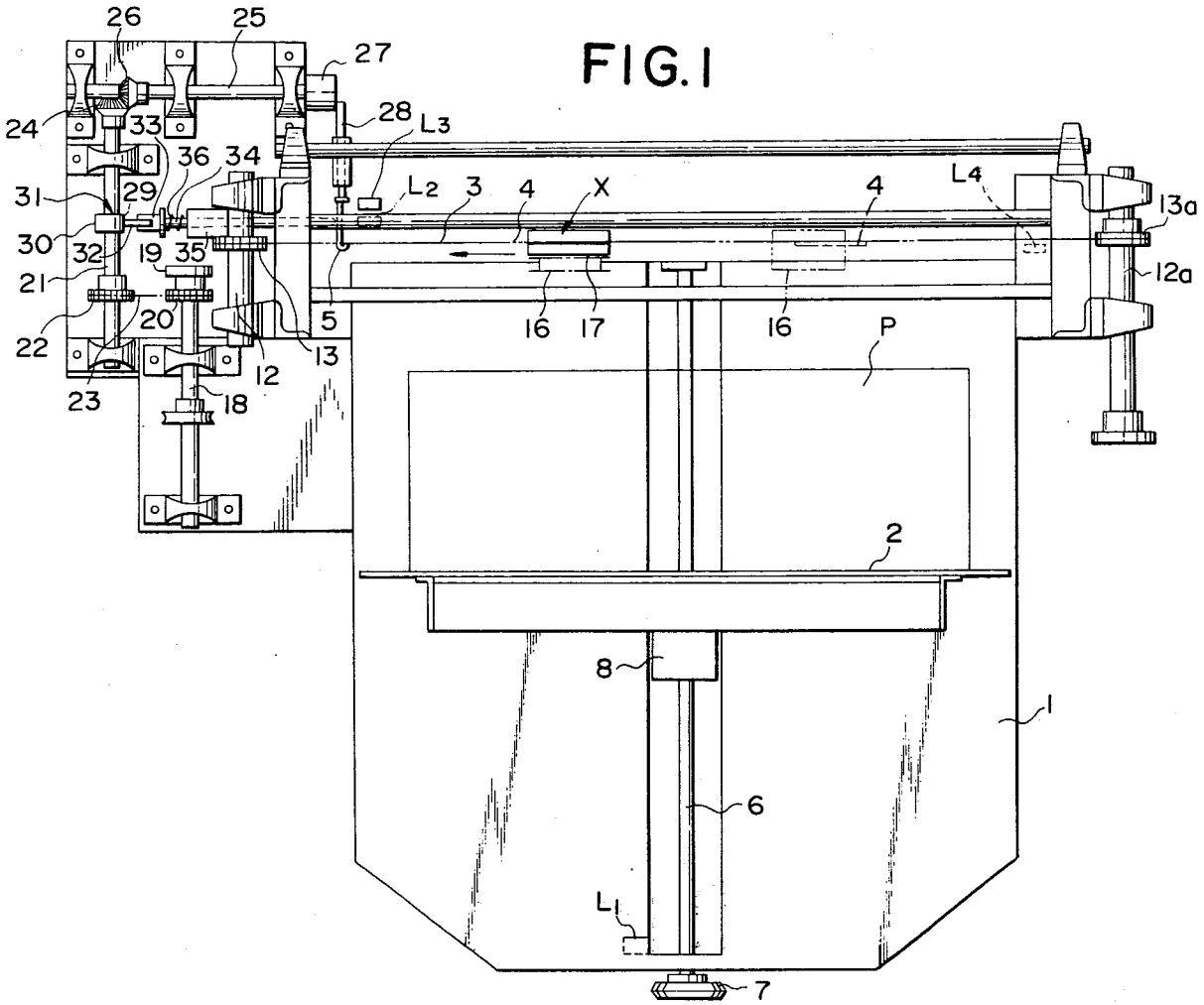
Figure 2:
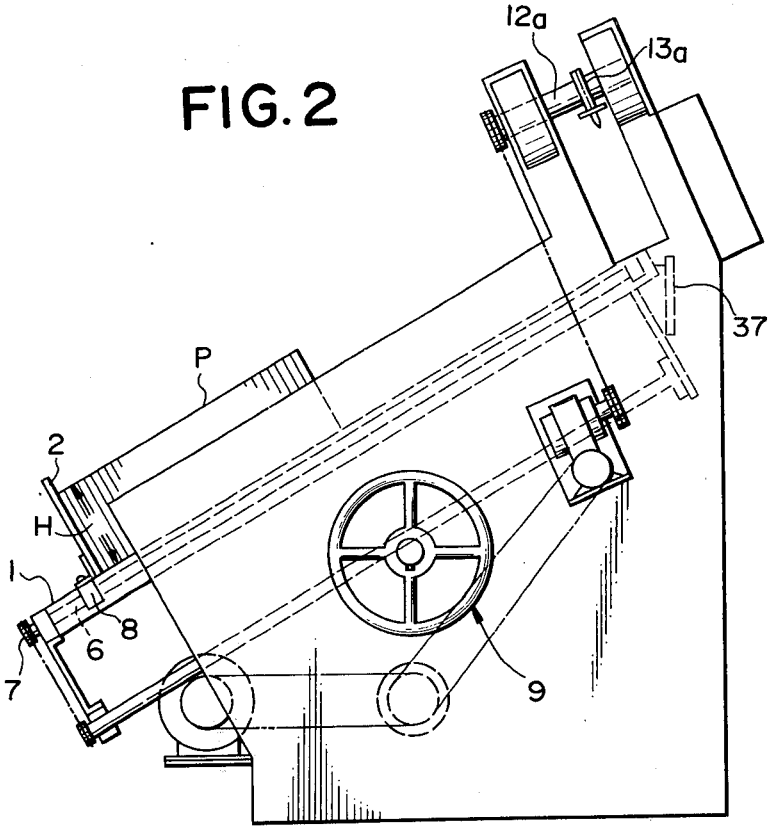
Figure 3:
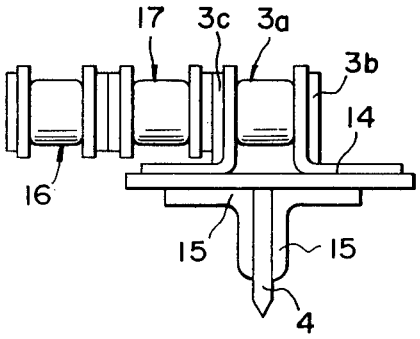
Figure 4:
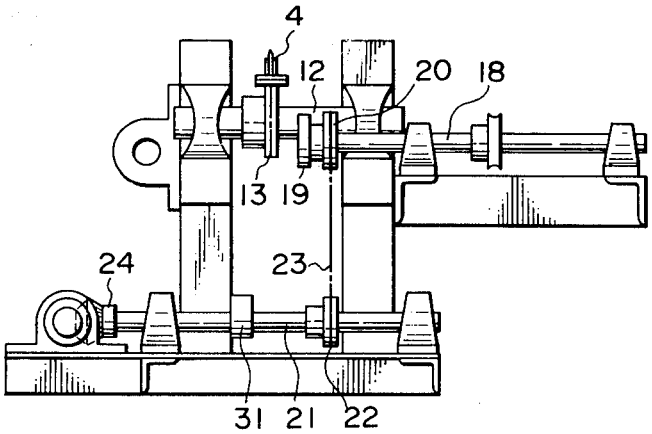

Other features and advantages of this invention will become apparent from the following description taken in conjunction with the accompanying drawings, in which:

FIG. 1 is a plan view of an embodiment of the back-splitting apparatus of this invention, FIG. 2 is a side view of the embodiment, FIG. 3 is a view showing the means with which a back-splitting cutter is mounted on a main chain, and FIG. 4 is a partial enlarged view of the left side in FIG. 1.

The back-splitting apparatus of this invention has a feeding mechanism which is composed of a table 1, a keeper plate 2, and a driving device for moving the keeper plate 2; and a back-splitting mechanism X which is composed of a main chain 3, back-splitting cutter knives 4 secured to the chain 3, and an open hook 5.

The back-splitting mechanism X is arranged at the fore end part of the table 1 for placing thereon laminated sheets of paper P whose rear parts are starched for back fixation. On the upper surface of table 1, there is arranged keeper plate 2 which transfers the laminated sheets of paper P placed on the table forward on the table 1, i.e., towards the back-splitting mechanism.

The laminated sheets of paper P are placed on the table 1 in such a manner that the starched rear parts face upwards, that is the direction of their lamination is the same as from the keeper plate 2 towards the back-splitting mechanism X, and that the rear end surface of their lamination is supported on the keeper plate 2. The width of keeper plate 2 is made substantially equal to that of table 1.

On the other hand, substantially at the center on the lower surface side of the table 1, there is disposed a rod screw 6 which extends from the rear end to the front end of the table 1. The rear end part of rod screw 6 is coupled with a driving device 7 which is composed of a motor and gears.

The keeper plate 2 is engaged with the rod screw 6 through a supporting member 8 which is in threadable engagement with the rod screw 6. By actuating the driving device 7 to rotate the rod screw 6, the keeper plate 2 can move upwards or downwards.

At the center of the rear end of the table 1, a first limit switch $L_1$ is arranged. When the keeper plate 2 has moved to the rear end of table 1, the supporting member 8 comes into contact with the limit switch $L_1$, whereby the operation of the driving device 7 is stopped.

A second limit switch $L_2$ is arranged in the vicinity of the fore end of the table 1. When, by moving the keeper plate 2 towards the front part of table 1, the front end surface of the lamination of the sheets of paper P placed on the table 1 has contacted with the limit switch $L_2$, the frontward movement of the keeper plate 2 is stopped, and simultaneously, the main chain 3 of the back-splitting mechanism X is turned.

Further, the table 1 can be vertically moved by any vertical regulation mechanism which includes a handle 9 for ascent and descent provided on a side of the table, a ratchet, and a rack and pinion mechanism. The vertical regulation mechanism can vertically move and regulate the table 1 according to the dimensions of the laminated sheets of paper placed on the table 1, so that the back-splitting operation by the back-splitting cutter knife 4 can be reliably conducted. In order that the laminated sheets of paper P placed on the table 1 may not fall forwards, the table 1 is inclined with the front part being higher.

On the other hand, the back-splitting mechanism X is arranged substantially at the front end part of table 1. As previously stated, it is actuated when the front end surface of the lamination of the sheets of paper P transferred by the keeper plate 2 has come into contact with the limit switch $L_2$.

As shown in FIG. 1, the back-splitting mechanism X has a main chain 3 extended over first gears 13 and **13*a* and secured to first rotary shafts 12 and 12*a* which are respectively disposed on the left and right sides of the front end of table 1 along the lengthwise direction of the table. The first rotary shaft 12 is rotated and driven upon the actuation of the limit switch $L_2$. The main chain 3 is disposed in a manner to be spaced from the surface of the table 1 by a distance which corresponds to more than the height H of the laminated sheets of paper P placed on the table 1. Thus, after the back-splitting stage of work (as performed under main chain 3 for the laminated sheets of paper P transferred to the front end part of the table 1) has been completed, the sheets of paper which correspond to the thickness of one back-split copy pass beneath the main chain 3 and are fed for the next stage of work from the front end of table 1**.

The main chain 3 has the back-splitting cutter knives 4 secured thereto in several places (in two places in the embodiment). As shown in FIG. 3, the back-splitting cutter knife 4 is held between two L-shaped flanges 15 and 15 which are secured to an attachment 14. The attachment 14 is secured to both side plates 3b and 3c of a chain element 3a of the main chain 3. At the position of the main chain 3 at which the back-splitting cutter knife 4 is mounted, first auxiliary chain elements 16, from five to seven or so in number are mounted so as to turn integrally with the main chain 3 through second auxiliary chain elements 17.

On the track of the first auxiliary chain elements 16, there is arranged a second gear 19 which is secured to one end of a second rotary shaft 18 which is parallel with the first rotary shaft 12. The second gear 19 meshes with the first auxiliary chain elements 16 when the back-splitting cutter knife 4 has moved to the position of the rotary shaft 18.

As regards the meshing between the first auxiliary chain elements 16 and the second gear 19, since the number of the first auxiliary chain elements 16 is five to seven, the second gear 19 falls into a free state and stops the rotating operation when the meshing of the five to seven chain elements has been completed.

The second rotary shaft 18 has a third gear 20 secured thereto. The third gear 20 is engaged through a chain 23 with a fourth gear 22 which is secured to one end of a third rotary shaft 21 disposed below the second rotary shaft 18 and extends parallel therewith.

Secured to the other end of the third rotary shaft 21 is a bevel gear 24. The bevel gear 24 meshes with a bevel gear 26 which is secured to one end of a fourth rotary shaft 25 extending towards the table 1 orthogonally to the third rotary shaft 21.

Secured to the other end of the fourth rotary shaft 25 is a stroke adjusting cam 27 for the open hook 5, as will be later described. At an eccentric position of the stroke adjusting cam 27, a crank 28 which stretches in the direction of the main chain 3 is turnably mounted.

At the extreme end of the crank 28, there is coupled open hook 5 which is formed substantially into the shape of a fishhook and which separates one side surface of the laminated sheets of paper P into the thickness (the number of sheets) of one copy when the lamination P is transferred to the predetermined position. By turning the stroke adjusting cam 27, the open hook 5 is slid frontwards or rearwards.

Between the gear 22 and the bevel gear 24 which are secured to the third rotary shaft 21, there is secured a cam 31 whose side shape is of substantially that of the letter D and has an arcuate surface portion 29 and a flat surface portion 30. A push rod mechanism is engaged with the cam 31. It presses the open hook 5 towards the laminated sheets of paper P when the open hook 5 has moved to the side surface near the front end part of the lamination P by the turning of the stroke adjusting cam 27.

The push rod mechanism is composed of a roller 32 which contacts the cam 31, a supporting member 33 which supports the roller 32, a rod 34 which is secured to the supporting member 33, a fixed guide member 35 which guides the movement of the rod 34 towards the laminated sheets of paper P, and a spring 36 which is retained between the fixed guide member 35 and the supporting member 33. When the roller 32 lies on the arcuate surface portion 29 of the cam 31 owing to the rotation of the cam 31, the rod 34 moves in the direction of pressing the open hook 5 towards the laminated sheets of paper P. On the other hand, when the roller 32 lies on the flat surface portion 30 of the cam 31, the rod 34 moves under the action of the spring 36 so that the open hook 5 may return towards the cam 31. That is, both the cam 31 and the stroke adjusting cam 27 are so designed that, when the open hook 5 has moved to the side surface of the laminated sheets of paper P, the roller 32 can contact the arcuate surface portion 29 of the cam 31.

Owing to the above construction, the extremity open hook 5 catches the sheet of paper at that position of the unstarched side surface of the lamination P which is spaced from the front end surface by the thickness corresponding to one copy, whereby it separates the lamination P into the thickness (the number of sheets) corresponding to one copy. A front cover and a rear cover are arranged for every copy in the laminated sheets of paper P, and the catching by the open hook is accurately executed.

The back-splitting cutter knife 4 which is conducted by the main chain 3 and which is moved in the inverted state is snugly inserted into an opening part of the lamination side surface.

A limit switch $L_3$ is interlocked with open hook 5. In case, in the above operation, when the open hook 5 fails to separate the sheets of paper corresponding to one copy, the limit switch $L_3$ is actuated to stop the turning of the main chain 3, i.e., to stop the entry of the back-splitting cutter knife 4.

In the vicinity of the other end part of the laminated sheets of paper P, a limit switch $L_4$ is disposed. The limit switch $L_4$ operates so as to stop the turning of the main chain 3 and simultaneously move the keeper plate 2 frontwards when the back-splitting cutter knife 4 (entered into the opening part from one end part of the laminated sheets of paper P by the operation of the open hook 5) comes into contact with the limit switch $L_4$ after performing the back-splitting operation and moving to the other end part.

The length by which the back-splitting cutter knife 4 hangs down enables it to reach the starched surface of the lamination P placed on the table 1. Where the laminated sheets of paper P are of small sizes for chits, memo-books, etc., the length may be regulated by moving the table 1 upwards with the vertical regulation mechanism.

A catching bar 37 is disposed outside the front end of the table 1. The sheets of paper P back-split by the back-splitting cutter knife 4 are caught by the catching bar 37 and thereafter transferred to the finishing stage of work.

The operation of this invention having the above construction will now be explained. The laminated sheets of paper P in which the plurality of brochures with the front and rear covers is position on every copy are piled up and the back side is starched and placed on the table 1 in such a manner that the fixed back portion faces upwards. The direction of lamination is the same as the direction from the keeper plate 2 towards the back-splitting mechanism X, and the rear end part of the lamination is supported on the keeper plate 2.

After setting the laminated sheets of paper P in this manner, the driving device 7 is actuated by the switch operation so as to move the keeper plate 2 frontwards. By the movement of the keeper plate 2, the laminated sheets of paper P are transferred to the front part of the table 1. When the front end surface of the laminated sheets of paper P comes into contact with limit switch $L_1$, the limit switch $L_1$ is actuated to stop the movement of keeper plate 2 and simultaneously to start the turning of the main chain 3.

When the back-splitting cutter knife 4 turns with the main chain 3, the driving chain elements 16 arranged at the position of the attachment of the back-splitting cutter knife 4 mesh with the second gear 19. Owing to the meshing between the driving chain elements 16 and the second gear 19, the stroke adjusting cam 27 and the cam 31 are actuated through third gear 20, fourth gear 22 and bevel gears 24 and 26. Then, the open hook 5 engages the portion in which the front and rear covers lie one over the other and separates the end part of the laminated sheets of paper P into the thickness of one copy. Subsequently, the back-splitting cutter knife 4 enters into the resultant open portion. The back-splitting cutter knife 4 turns integrally with the main chain 3, and moves from one end part to the other end part of the lamination P while splitting the fixed back portion.

Upon completion of the back splitting for one copy, the back-splitting cutter knife 4 comes into contact with limit switch $L_4$. By the actuation of limit switch $L_4$, the turning of the main chain 3 is stopped, and the keeper plate 2 is moved forwards again. The new front end surface of the laminated sheets of paper P comes into contact with the limit switch $L_2$, and the same operation as described above is repeated. The back-split sheets of paper are caught by the catching portion provided outside the table 1, and are fed to the next stage of work.

While the foregoing back-splitting apparatus is of the horizontal type wherein the back-splitting operation is done by transferring the laminated sheets of paper substantially parallel with the floor, a vertical type apparatus can be obtained by erecting the foregoing apparatus substantially perpendicular to the floor.

In this case, the plan view of FIG. 1 which is the explanatory view of the previous embodiment corresponds to a front view. The keeper plate 2 becomes a bed for placing the laminated sheets of paper thereon, and the bed is made vertically slidable by a rod screw. At predetermined positions of an upper part, there is arranged a back-splitting mechanism and a gear mechanism which have the same construction as in the previous embodiment.

In a case of a vertical type apparatus, the laminated sheets of paper placed on the bed have their fixed back portion directed towards the front.

By the actuation of the main chain which is thus arranged so as to turn in the horizontal direction, the back-splitting cutter knife can enter into the back portion of the lamination.

This invention has the construction and operation as stated above. The back-splitting operation can be reliably and safely performed with the back-splitting cutter attached to the turnable main chain, and it can be mechnically effected by switch operating, so that the productivity can be enhanced several times in comparison with the prior-art back-splitting job by hand. In the prior art, since the back-splitting job has been done by hand, it has been difficult to back-split a succession of three to four copies in the lengthwise direction of the back portion at one time. In contrast, the sheets of paper for three to four copies succeeding in the lengthwise direction of the back portion can be back-split at once by the apparatus of this invention. Further, since the apparatus can be simply operated by one operator, personnel expenditure can be saved and a sharp reduction in cost can be achieved.

What I claim is:

1. Back-splitting apparatus in the production of a brochure, comprising:

a feeding mechanism which transfers laminated sheets of paper to a predetermined position, said laminated sheets of paper having front and rear covers arranged for each copy and having back fixation of a thickness corresponding to several copies;

first rotary shafts which are disposed on the right and left at said predetermined position in a manner to be suitably spaced from a rear part surface of said laminated sheets of paper and to have an interval greater than at least a width of said laminated sheets of paper;

first gears which are respectively secured to said first rotary shafts;

a main chain extending over said first gears;

a first limit switch arranged at said predetermined position, said first limit switch being connected to stop the operation of said feeding mechanism and simultaneously activate said main chain when said laminated sheets of paper have been transferred to said predetermined position;

back-splitting cutter knives secured to said main chain, each knife having a length reaching the rear part of said laminated sheets of paper;

a gear mechanism arranged by the side of said rotary shaft;

an open hook reciprocated by the drive of said gear mechanism so as to separate an end part of said laminated sheets of paper at said predetermined position into a thickness of one copy;

auxiliary chain elements secured to said main chain and meshing with said gear mechanism when said back-splitting cutter knife has moved to the vicinity of one end part of said main chain;

a second limit switch in the vicinity of the other end part of said main chain connected to stop the turning of said main chain and actuate said feeding mechanism when said back-splitting cutter knife has moved from said one end part to said other end part; and said back-splitting cutter knife being positioned to thrust from the end part of said laminated sheets of paper into said rear part thereof after said open hook has operated.

2. The back-splitting apparatus in the production of a brochure according to claim 1, wherein said feeding mechanism comprises a table on which said laminated sheets of paper are placed, a keeper plate disposed on said table, and a rod screw extending from a rear end part to a front end part on the backside of said table and coupled with said driving mechanism, and wherein said keeper plate is secured to a supporting member threadably engaged with said rod screw to be reciprocated in forward and rearward directions of said table by turning of said rod screw.

3. The back-splitting apparatus in the production of a brochure according to claim 1, wherein said feeding mechanism comprises a bed on which said laminated sheets of paper are placed, and a rod screw extending from a lower part to the upper predetermined position and coupled with a driving device, and wherein said bed is secured to a supporting member threadably engaged with said rod screw and can be vertically slid by turning of said rod screw.

4. The back-splitting apparatus in the production of a brochure according to claim 1, wherein said back-splitting cutter knife is held between two L-shaped flanges secured to both side plates of a chain element of said main chain.

5. The back-splitting apparatus in the production of a brochure according to claim 1, wherein said auxiliary chain elements are secured to a side part of said main chain at the position of the mounting of said back-splitting cutter knife.

6. The back-splitting apparatus in the production of a brochure according to claim 1, wherein said gear mechanism comprises:

a second rotary shaft disposed parallel to said first rotary shaft;

a second gear secured to said second rotary shaft on a track of said auxiliary chain elements and meshing with said auxiliary chain elements when they have moved to one end part;

a third gear secured to said second rotary shaft;

a third rotary shaft arranged below and parallel to said second rotary shaft;

a fourth gear secured to one end of said third rotary shaft and engaged with said third gear through a chain;

a first bevel gear secured to the other end of said third rotary shaft;

a fourth rotary shaft arranged orthogonally to said third rotary shaft;

a second bevel gear secured to one end of said fourth rotary shaft and meshing with said first bevel gear;

a stroke adjusting cam secured to the other end of said fourth rotary shaft; and said open hook being coupled to an extreme end of a crank which is pivotally mounted on an eccentric position of said adjusting cam.

7. The back-splitting apparatus in the production of a brochure according to claim 1, wherein said open hook is formed substantially into the shape of a fishhook.

8. The back-splitting apparatus in the production of a brochure according to claim 5, wherein a cam whose side shape having an arcuate surface portion and a flat surface portion is substantially of the letter D is secured to said third rotary shaft, and a push rod mechanism which presses said open hook towards said laminated sheets of paper is engaged with said cam.

9. The back-splitting apparatus in the production of a brochure according to claim 8, wherein said push rod mechanism comprises a roller which contacts said cam, a supporting member which supports said roller, a rod secured to said supporting member, a fixed guide member which guides the movement of said rod towards said laminated sheets of paper, and a spring retained between said fixed guide member and said supporting member.

* * * * *